US006062108A

United States Patent [19]

Rosero

[11] Patent Number: 6,062,108

[45] Date of Patent: May 16, 2000

[54] MAGNETIC HAMMER

[76] Inventor: Maximo Rosero, 6311 NW. 1st Pl., Miami, Fla. 33150

[21] Appl. No.: 09/289,824

[22] Filed: Apr. 12, 1999

[51] Int. Cl.[7] ..... B25D 1/00

[52] U.S. Cl. ..... 81/24; 81/20

[58] Field of Search ..... 81/22–25

[56] References Cited

U.S. PATENT DOCUMENTS

| | | |
|---|---|---|
| 2,482,909 | 9/1949 | Hertz . |
| 2,671,483 | 3/1954 | Clark . |
| 2,788,815 | 4/1957 | D'Aoust . |
| 3,580,312 | 5/1971 | Hallock . |
| 3,763,906 | 10/1973 | Crowder . |
| 4,073,327 | 2/1978 | Pearson . |
| 4,291,736 | 9/1981 | Robertson et al. . |
| 4,340,101 | 7/1982 | Schar . |
| 4,448,230 | 5/1984 | Reed . |
| 4,512,381 | 4/1985 | Alvarez . |
| 4,610,188 | 9/1986 | Hallock . |
| 4,753,137 | 6/1988 | Kennedy . |
| 4,753,138 | 6/1988 | Soucy . |
| 4,876,928 | 10/1989 | Gaulin . |
| 5,000,064 | 3/1991 | McMahon . |
| 5,178,048 | 1/1993 | Matechuk . |
| 5,216,939 | 6/1993 | Swenson . |
| 5,372,053 | 12/1994 | Lee . |
| 5,546,832 | 8/1996 | Townsend . |

*Primary Examiner*—James G. Smith
*Assistant Examiner*—David B. Thomas
*Attorney, Agent, or Firm*—Kenneth L Tolar

[57] ABSTRACT

A magnetic hammer includes an elongated handle having an upper end and a lower end with a hammer head mounted to the upper end. The hammer head includes a nail engaging portion having a bore therein for removably receiving an electromagnetic insert. A switch means on the handle delivers power from a power source within the handle to the electromagnet whereby a nail may be magnetically secured to the hammer head.

6 Claims, 2 Drawing Sheets

MAGNETIC HAMMER

BACKGROUND OF THE INVENTION

The present invention relates to a hammer having a removable electromagnet within the head portion for temporarily securing nails thereto.

DESCRIPTION OF THE PRIOR ART

Using a conventional claw hammer to drive nails has long been tedious in that the nail must be held in place with one hand while the hammer is manipulated with the other. Such practice is somewhat dangerous in that the worker often strikes his or her hand with the hammer while holding the nail in place. Various magnetic hammer heads and magnetic inserts for conventional hammer heads exist in the prior art in an attempt to alleviate this problem. However, the conventional magnetic hammer heads are inconvenient in that the hammer head is continuously magnetized unless the magnet is removed. Usually magnetization is only required to initially secure the nail to the hammer head for partially driving the nail. Once the nail is partially driven, magnetization is no longer necessary. Accordingly, with the conventional magnetized hammers, the hammer head will be magnetically attracted to the nail each time the nail head is struck thereby hindering the hammering process.

The present invention provides a new and improved magnetic hammer that includes a removable electromagnetic insert which may be selectively activated with a switch allowing the hammer to be interchangeably used as either a magnetic hammer or a conventional hammer. Various magnetic hammers and devices for attaching nails to a hammer head exist in the prior art. For example, U.S. Pat. No. 5,000,064 issued to McMahon relates to a magnetic tacking hammer handle.

U.S. Pat. No. 4,610,188 issued to Hallock relates to a magnetic driving tool.

U.S. Pat. No. 4,753,138 issued to Soucy relates to a magnetic hammer handle cap.

U.S. Pat. No. 4,340,101 issued to Schär relates to a nailing tool.

U.S. Pat. No. 2,788,815 issued to D'Aoust relates to a hammer with a magnetic nail placer.

U.S. Pat. No. 2,671,483 issued to Clark relates to a magnetic hammer.

Although various magnetic hammers exist in the prior art, none relate to a hammer having a removable, switch activated electromagnet for selectively magnetizing the hammer head.

SUMMARY OF THE INVENTION

The present invention relates to a magnetic hammer including an elongated substantially hollow handle member having a hammer head attached to the upper end thereof. The hammer head includes a front face that normally engages a nail head when the hammer is being used to drive a nail. The front face includes an opening in communication with an elongated bore for removably receiving an electromagnetic insert. When installed within the bore, the electromagnetic insert may be selectively activated with a switch means allowing the hammer to be used as either a conventional hammer or a magnetic hammer. It is therefore an object of the present invention to provide a hammer having a head which may be selectively magnetized.

It is another object of the present invention to provide a hammer having a head with an electromagnet insert removably received therein. Other objects, features and advantages of the present invention will become readily apparent from the following detailed description of the preferred embodiment when considered with the attached drawings and the appended claims.

DESCRIPTION OF THE PREFERRED EMBODIMENT

Figure 2:
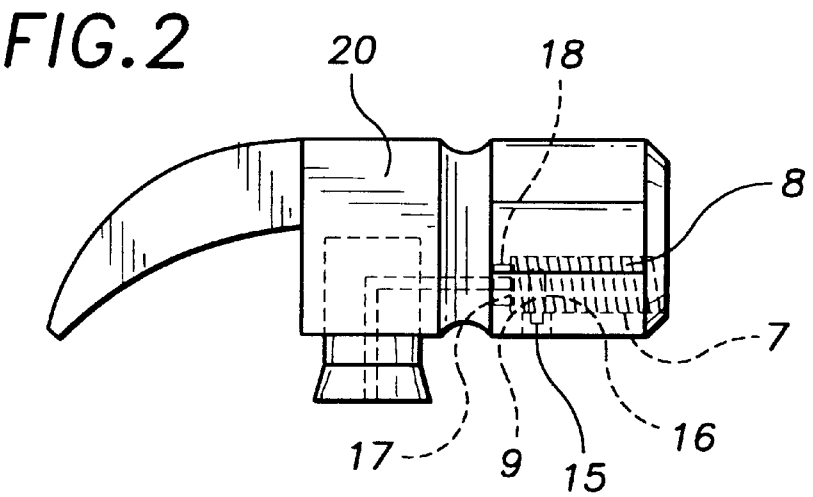
FIG. 2 is a closeup view of the hammer head.
Figure 1:
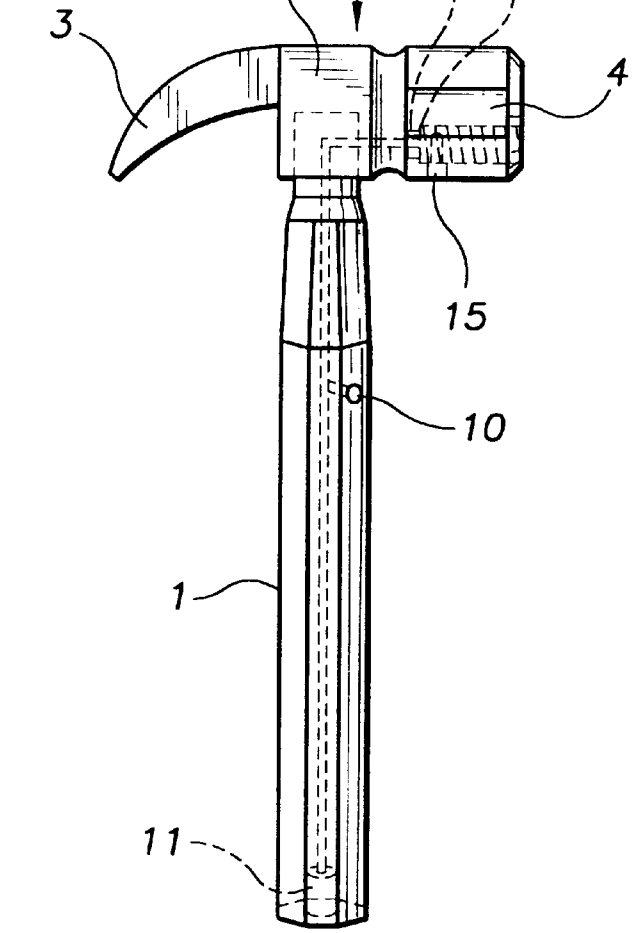
FIG. 1 is a plan view of the hammer according to the present invention with the internal components depicted in phantom.
Figure 4:
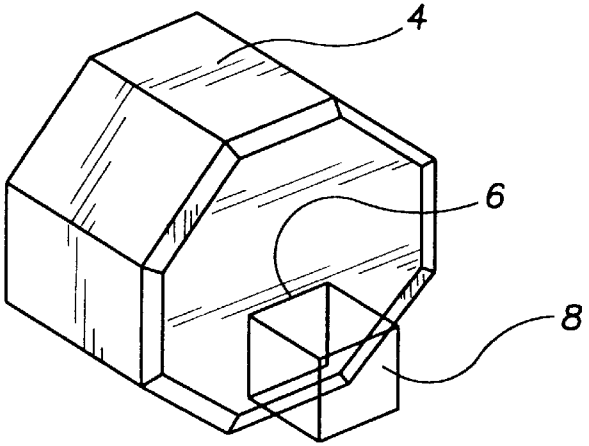
FIG. 4 is a perspective view of the nail engaging portion of the hammer head.
Figure 3:
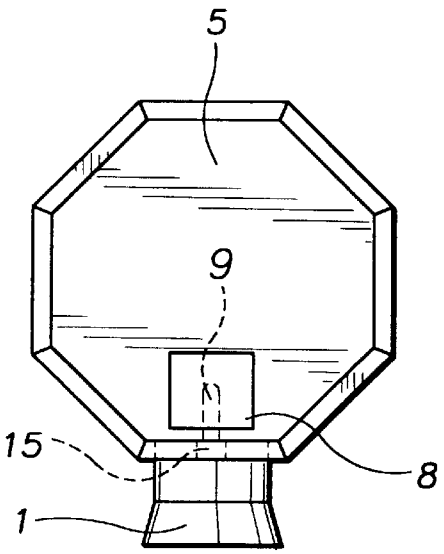
FIG. 3 is a view of the front face of the hammer head.

Referring now to FIGS. 1 and 4, the present invention relates to a magnetic hammer. The device includes an elongated substantially hollow handle member 1 having an upper end and a lower end. Mounted to the upper end of the handle member is a hammer head 2 having an intermediate portion 20 with a claw 3 on one side and a nail engaging portion 4 on the opposing side.

The nail engaging portion 4 includes a substantially planar face 5 that engages a nail head when the hammer is being used to drive nails. The face includes a substantially rectangular opening 6 in communication with an internal bore 7. Removably received within the bore is an electromagnetic insert 8. The electromagnetic insert is securely locked within the bore using a threaded pin 9, bolt or similar fastener means that threadedly engages a threaded aperture 15 on the nail engaging portion of the hammer head as well as a threaded aperture 16 on the electromagnetic insert when the apertures are aligned.

An end of the insert includes a contact plate 17 that engages a second contact plate 18 within the bore whenever the insert is properly installed therein. The second contact plate 18 is electrically connected to a power source 11 such as a battery that is received within the handle. On the exterior surface of the handle is a switch means 10 electrically connected to both the battery and the second contact plate for selectively activating the electromagnet. Accordingly, the face of the nail engaging portion may be selectively magnetized by activating the switch means.

The hammer head is preferably constructed with a metallic material while the handle is preferably constructed with wood. However, as will be readily apparent to those skilled in the art, the size, shape and materials of construction may be varied without departing from the spirit of the present invention.

Although there has been shown and described the preferred embodiment of the present invention, it will be readily apparent to those skilled in the art that the above described invention is not to be limited to the exact details of construction and arrangement of parts as shown and described and that modifications may be made thereto which do not exceed the scope of the appended claims. Therefore, the scope of the invention is only to be limited by the following claims.

What is claimed is:

1. A magnetic hammer comprising:

an elongated handle having an upper end and a lower end;

a hammer head mounted to the upper end of said handle member, said hammer head including a nail engaging portion;

an electromagnet removably received within the nail engaging portion of said hammer head which may be selectively activated to magnetize said hammer head.

2. A magnetic hammer according to claim 1 further comprising means for securing the electromagnet within said nail engaging portion.

3. A magnetic hammer according to claim 2 wherein said means for securing said magnet within said nail engaging portion comprises:

a threaded fastener means threadedly engaging a first aperture on said electromagnet and a second aperture on said nail engaging portion.

4. A magnetic hammer according to claim 3 further comprising a power means received within said handle for providing electricity to said electromagnet.

5. A magnetic hammer according to claim 4 further comprising a switch means electrically connected to said power means and said electromagnet for selectively activating said electromagnet.

6. A magnetic hammer comprising:

an elongated substantially hollow handle member having an upper end and a lower end;

a hammer head mounted to the upper end of said handle, said hammer head including a nail engaging portion, said nail engaging portion including a bore;

an electromagnet removably received within said bore;

means for securing said electromagnet within said bore;

a power source received within said handle for providing electricity to said electromagnet;

a switch means mounted on said handle for selectively delivering power from said power source to said electromagnet.

* * * * *